United States Patent [19]

Broihanne et al.

[11] Patent Number: 4,700,768

[45] Date of Patent: Oct. 20, 1987

[54] METAL CASTING PROCESS USING A LOST PATTERN, MOULDS FOR PERFORMING THIS PROCESS AND PROCESS FOR THE PRODUCTION OF SAID MOULDS

[75] Inventors: Georges Broihanne, Pau; Pierre Magnier, Chatenay-Malabry, both of France

[73] Assignees: U.C.P.I. Societe pour l'Utilisation des Ceramiques et des Platres dans l'Industrie, Paris; Messier Fonderie D'Arudy, Arudy, both of France

[21] Appl. No.: 865,600

[22] Filed: May 23, 1986

Related U.S. Application Data

[63] Continuation of Ser. No. 675,637, Nov. 28, 1984, abandoned.

[30] Foreign Application Priority Data

Dec. 14, 1983 [FR] France ..... 83 20019

[51] Int. Cl.[4] ..... B22C 1/22; B22C 9/04

[52] U.S. Cl. ..... 164/361; 164/518; 164/525; 164/526; 106/38.35; 106/38.23

[58] Field of Search ..... 164/524, 525, 526, 527, 164/528, 529, 516–519, 361; 106/38.27, 38.28, 38.23, 38.35

[56] References Cited

U.S. PATENT DOCUMENTS

| | | | |
|---|---|---|---|
| 2,752,257 | 6/1956 | Bradley et al. | 106/38.35 X |
| 2,948,627 | 8/1960 | Field | 106/38.23 X |
| 3,204,303 | 9/1965 | Chandley | 164/361 X |
| 3,266,106 | 8/1966 | Lirones | 164/519 X |
| 3,903,950 | 9/1975 | Lirones | 106/38.35 X |

FOREIGN PATENT DOCUMENTS

| | | | |
|---|---|---|---|
| 49-45825 | 5/1974 | Japan | 164/529 |

*Primary Examiner*—Kuang Y. Lin

*Attorney, Agent, or Firm*—Sixbey, Friedman & Leedom

[57] ABSTRACT

There is disclosed a mould for lost pattern casting. The shell of the mould comprises a graphite coating and a hydrocarbon binder. The binder comprises a polyol with at least three alcohol functions such as pentaerithritol.

8 Claims, 5 Drawing Figures

METAL CASTING PROCESS USING A LOST PATTERN, MOULDS FOR PERFORMING THIS PROCESS AND PROCESS FOR THE PRODUCTION OF SAID MOULDS

This application is a continuation of application Ser. No. 675,637, filed Nov. 28, 1984, now abandoned.

The present invention relates to a metal moulding process using a lost pattern, the metals being in particular titanium and its alloys, as well as to moulds for performing this process and to processes for the production of said moulds.

The casting of molten titanium and its alloys in a mould is subJect to a major difficulty, namely the reactivity of the molten metal relative to all known refractory materials at the very high temperature necessary for casting the metal of 1800°to 2000° C.

At such temperatures, the molten titanium reduces all oxides and refractory compounds, namely alumina, glucina, rutile, zirconia, zirconium, etc. The reaction leads to oxygen being absorbed by the metal and to an unacceptable modification of the mechanical characteristics of the castings produced. These reactions between the titanium and the oxides increase when the metal is melted and cast under a vacuum of at least $10^{-1}$ Torr, which facilitates the decomposition of the materials constituting the mould.

One of the only refractory materials which can be resisted by molten titanium at 2000° C. without any violent reaction is graphite or the various forms of carbon. However, contact must be relatively short, otherwise the carbon slowly dissolves into the liquid metal, leading to an increase in the hardness of the castings, which may become unacceptable or require machining.

It is also possible to produce machined graphite casting moulds, but this solution rapidly becomes excessively costly if the castings to be reproduced have a complex shape. It is also possible to fix or shrink onto a permanent pattern graphite mixtures in the form of powders or agglomerated granules with thermosetting or setting casting resins using a catalyst in a procedure similar to that of conventional sand casting. These moulds are generally baked in vacuo and introduced into the melting oven under a vacuum in order to receive the molten metal.

Althorgh they make it possible to obtain sound and relatively accurate castings, these processes do not make it possible to produce complex castings with close dimensional tolerances characterizing lost pattern casting processes with metals and alloys, such as steels or alloys of aluminium.

Processes are also known in which a graphite shell is produced in the form of successive layers around a pattern or an assembly of patterns made from wax, this procedure being well known in lost pattern casting. For the titanium, the ceramic materials generally used are replaced by graphite materials in powder and granule form, whilst the mineral ceramic binders are replaced by purely organic binders.

The production of such shells with a thickness of a few centimetres leads to considerable difficulties, because the organic binders do not rapidly attain the hardness of mineral binders. Moreover, they decompose at 150°to 200° C. and the thus produced shell can be subject to deformation and cracking on removing the wax and on baking in vacuo. Thus, the castings do not always have the desired appearance and reproduction and the number of rejects involved can be high.

The present invention is directed at a mould for lost pattern casting, specifically a shell and a block associated therewith and which obviates the disadvantages referred to hereinbefore.

The shell comprises graphite and a hydrocarbon binder. According to the invention, the binder comprises a polyol having at least three alcohol functions. This shell has a relatively good titanium resistance after baking.

Among the polyols which can be used in the composition of the binder are triols, such as glycerine and hexols such as sorbitol. Preference is given to tetrols. Preference is given to polyols with a quaternary carbon atom, whose carbon-containing coking residue is high on baking. By far the most preferred polyol is pentaerythritol, whose melting point of 250° C. is relatively high, so that it has a good resistance on removing the wax, which is insoluble in water, so that it does not increase the viscosity of the slip used in the preparation of the shell and which is insoluble in alcohol, so that the shell is not modified by successive dipping processes and during the production of the block. Generally, the polyol represents approximately 6–12%, to 6 to 8% of the weight of the shell.

Preferably, the graphite is a mixture of powders with different grain sizes variable between 0 and 1000 microns and represents 76 to 84% by weight of the shell. Correspondingly, the binder represents 24 to 16% by weight of the shell and, apart from the polyol, contains a polyvinyl binder which optionally is an acrylic binder, as well as optionally adjuvants.

According to a preferred variant, the shell comprises an inner layer having the constitution referred to hereinbefore, coated with an outer mineral layer of colloidal silica, colloidal alumina or aluminosiliceous colloids.

For example, use is made of colloidal silica in an aqueous medium or silicic acid in an alcoholic medium. This external mineral coating acts as an attachment coating to the block, whose binder is siliceous or aluminosiliceous. The external mineral coating generally represents approximately 4 to 6% of the total weight of the shell.

The shell is generally approximately 0.8 to 3 mm thick and is preferably 1 to 2 mm thick. Below 0.8 mm it is not able to fulfil as adequately its function of ensuring an inert contact with the titanium and of not being porous. Above 3 mm, cracking can appear during the baking of the mould.

The shell, whose main function is to ensure an inert contact, has a very inadequate mechanical strength for containing the molten metal to be poured. It is virtually impossible to increase the thickness of the shell, on the one hand because the latter would split on baking and on the other hand because it would deform, so that the mould cavity would lose its geometrical integrity. It is for this reason that a block is formed round the shell.

Apart from its mechanical reinforcing function around the shell, the block must also absorb the heat from the molten metal as quickly as possible, so as to solidify and cool the latter as quickly as possible. This limits the dissolving of the carbon in the metal, which improves the mechanical characteristics of the moulded titanium casting.

In order to increase the thermal diffusivity, the block is largely constituted by graphite (40 to 50% by weight). In order to obtain an adequate mechanical strength after baking, the block also contains 15 to 25% of refractory mineral substances, such as aluminium oxide, zirconium oxide or zirconium silicate, chosen from among the mineral compounds which are refractory at 1800° C. and above and which have the best thermal diffusivity. In order to further improve the latter characteristic, as well as the mechanical strength, the constituents of the block have a grain size between 0 and 3 mm and are intimately mixed in such a way that the final specific gravity exceeds 1.6. In order to bond the graphite and oxide grains or refractory compounds, use is made of a bonding agent which does not disappear during the vacuum baking of the mould at 1000° C. The baking prior to casting is necessary in order to eliminate any gaseous phase, which would otherwise appear at the time of casting the molten metal. Use is made of a mineral binder chosen from among the colloidal silica, colloidal alumina and aluminosiliceous colloids. The invention is also directed at a process for producing a mould according to the invention consisting of dipping a lost wax casting in a slip containing graphite and a polyol having at least three alcohol functions, drying the graphite layer, dipping the pattern coated with the graphite coating in a mineral slip containing a solution of colloidal silica, colloidal alumina or aluminosiliceous colloids, drying the pattern coated with the graphite and mineral coatings and pouring a slip containing 40 to 50% by weight of graphite, 15 to 25% by weight of refractory mineral compound at 1800° C. and 30 to 40% by weight of a mineral binder based on colloidal silica or colloidal alumina or aluminosiliceous colloids around the pattern coated with the graphite and mineral coatings.

FIG. 1 illustrates a wax-assembled pattern coated with a graphite coating,

FIG. 2 illustrates the pattern of FIG. 1 with its shell,

FIG. 3 illustrates the pattern and shell of FIG 2 in a box for forming a block therearound, FIG. 4 illustrates the block, pattern and shell of FIG. 3 with the wax pattern removed, and FIG. 5 illustrates the mould of the present invention containing liquid titanium.

Figure 1:
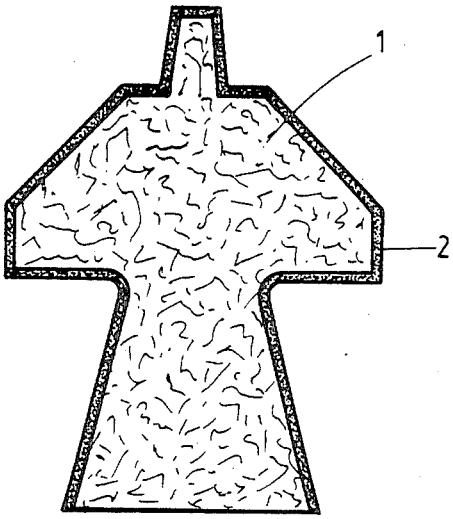
FIGS. 1 to 5 illustrate the various stages of the casting process according to the invention.
Figure 2:
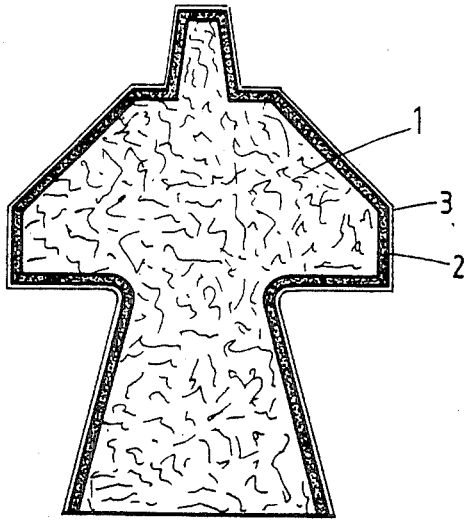

The first stage of the process according to the invention consists of producing a shell according to the invention. It is necessary to start with a wax-assembled pattern 1, prepared in accordance with conventional lost wax or investment casting procedures, either by injecting liquid wax into a metal mould, or by casting the same type of material by gravity into a mould representing in negative form the casting to be obtained. If necessary, the wax patterns with the supply means and other accessories are assembled by adhesion or welding. It is possible to use alone or in combination other fusible materials, which can be eliminated by heating the mould at 150 to 200° C., such as urea, polystyrene, etc. The wax pattern is dipped in a dipping slip constituted by an aqueous suspension of graphite powder and organic binders. The slip particularly contains powdered graphite with a grain size of 0 to 50 microns, in an amount 35 to 55% by weight, water in an amount of 17 to 28% by weight, one or more organic binders, such as polyvinyl binders , which optionally are acrylic binders, in amount of 20 to 30% by weight and the polyol according to the invention and especially pentaerythritol in an amount of 6 to 12% by weight. The slip can also contain less than 3% by weight of various adjuvants, such as antifoaming agents, like higher octyl alcohols, as well as ionic or anionic wetting agents, such as detergents.

The wax pattern is removed from the slip and drained, so as to leave a first 0.10 to 0.15 mm coating which is sprinkled with 0.05 to 0.3 mm and preferably 0.1 to 0.2 mm graphite grains, which are intended to become attached to the coating without perforating the same. Following drying for approximately 5 hours, it is possible to recommence the operation by sprinkling with larger grains, e.g. having a grain size distribution between 0.5 and 1 mm, so as to produce a graphite coating having a certain thickness. Thus, there may be three or four coatings in order to obtain the requisite thickness of the internal graphite coating 2.

The second stage of the process consists of depositing an external mineral coating 3 on coating 2. For this purpose,the wax pattern 1 covered with coating 2 is dipped in a mineral slip containing a solution of colloidal silica, colloidal alumina or aluminosiliceous colloids. Dipping lasts between 5 seconds and 2 minutes. Use is generally made of colloidal silica in an aqueous medium or silicic acid in an alcoholic medium. These suspensions impregnate the outer part of coating 2 in order to form an external mineral attachment coating 3. This coating represents 4 to 6% by weight of the pair of coatings 2 and 3.

Figure 3:
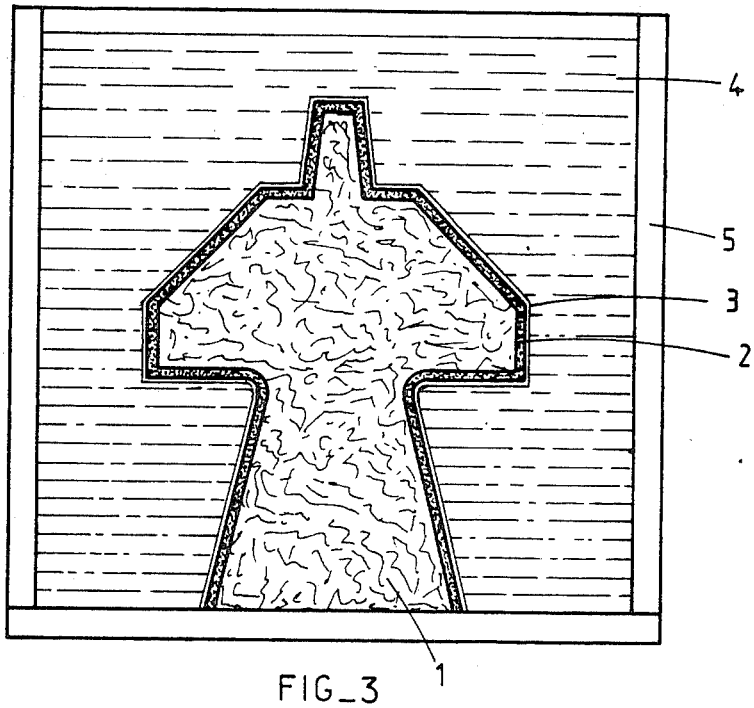

In order to produce the block (FIG. 3), the two constituents formed by graphite and the refractory compound are intimately mixed therewith and a slip is formed with 0.3 to 0.5 liter of binder per kg of solid material. This binder is also a colloidal silica or alumina phase suspended in water or alcohol. This slip 4 is then poured into a removable box 5 (FIG. 3) containing the pattern 1 and its shell 2, 3. In order to obtain a better density, it is advantageous to place the box on a vibrating table during filling. In order to bring about complete setting of the binder, whereby said setting can be regulated to between 15 and 60 minutes after filling, use is e.g. made of 0.01 to 0.1% of an amine, such as piperidine or triethylamine mixed with the binder in the case where the latter is an ethyl silicate hydrolyzed with 15 to 30 and preferably 20 to 25% of silica. Following the complete setting of the block, it is advantageous to remove it from the mould and allow it to dry and harden for 1 or more days.

Figure 4:
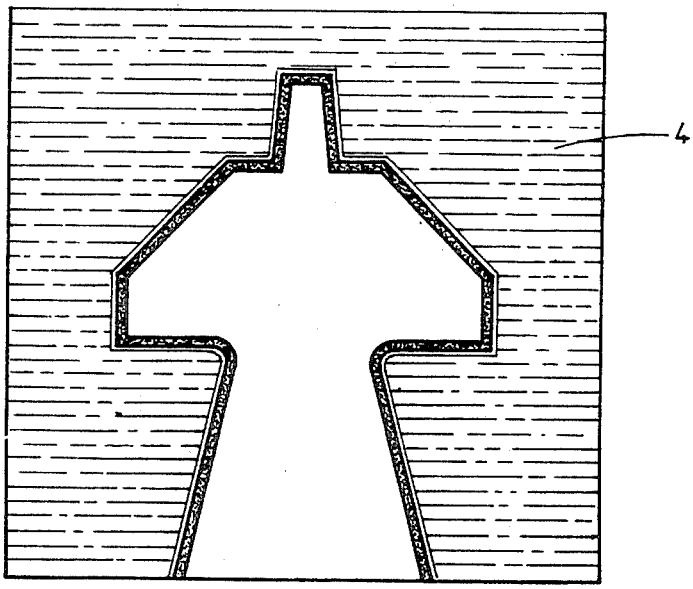

The following stage of the process according to the invention insists of eliminating the wax pattern by heating the mould in an oven at between 100°and 200° C. and preferably between 120°and 160° C. until the material forming the pattern melts and flows (FIG. 4). Heating to above 200° C. should not take place, in order not to violently decompose the binders of the shell.

Figure 5:
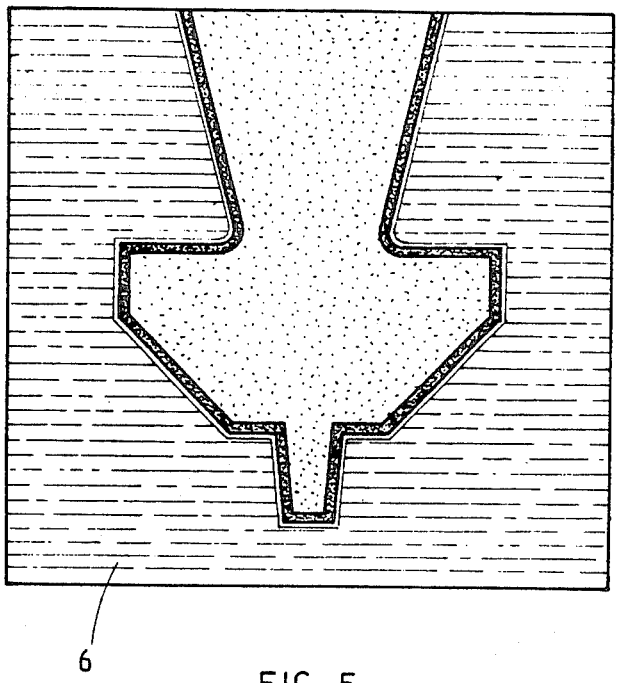

Dewaxing is followed by baking at between 900° and 11OO° C. and preferably between 950° and 1OOO° C. which serves to give the final mechanical strength to the block, eliminate all volatile substances and coke the organic substances. In order to prevent the combustion of the latter, baking advantageously takes place in vacuo or under a non-oxidizing atmosphere, such as a nitrogen or argon atmosphere under a mould temperature which is maintained for 1 to 6 hours and preferably 2 to 3 hours. Following baking, the mould 6, formed by the shell and the block is introduced into the melting oven in vacuo and liquid titanium is poured into it by gravity or in source. The titanium is generally brought into the liquid state by the energy of an electric arc or an electron bombardment beam, or in any other appropriate manner. It is advantageously possible to preheat the mould block by 20°to 350° C., as a function of the parts to be cast (FIG. 5).

After cooling, the mould block can be removed from the oven and broken by mechanical action and vibration in order to extract the casting. The latter has a very sound surface state. Thus, it is possible to reach 2 to 4 Ra-microns of surface roughness. The dimensional tolerances can reach J13 to J14 according to AFNOR standard E04-120. Even on a solid part, it is possible to obtain solidification grains of 2 to 1O mm.

The following examples serve to illustrate the invention .

EXAMPLE 1

Producing a titanium alloy casting from a wax pattern thereof.

Shell

| Dipping the wax for 15 seconds in a slip of composition: | |
|---|---|
| 0-50 micron powder graphite | 35/45% |
| water | 20/25% |
| acrylic binder | 8/10% |
| polyvinyl binder (non-acrylic) | 12/16% |
| pentaerythritol | 6/10% |
| miscellaneous adjuvants | less than 3% |
| Drain for 10 to 30 seconds | |
| Sprinkle with 0,1 to 0.3 mm graphite grains | |
| Dry in air for 3 hours | |
| Dip again | |
| Sprinkle with 0.5 to 1 mm graphite grains | |
| Dry in air for 3 hours | |
| Dip again | |
| Sprinkle with 0.5 to 1 mm graphite grains | |
| Dry in air for 4 hours | |
| Dip in a 30% silica | |
| colloidal solution for 20 to 60 seconds | |
| Drain for 1 minute | |
| Dry in air for 6 hours. | |

Block

The following granule are mixed for 15 minuntes in a rotary drum:

| | |
|---|---|
| 0 to 2.8 mm graphite | 45/55% |
| 0.5 to 1 mm graphite | 10/16% |
| 0.1 to 0.3 mm graphite | 4/8% |
| 0 to 50 micron fritted alumina | (25/35%) |

The mixture is placed in slip with 0.35 liter of ethyl silicate hydrolyzed with 25% silica with 0.05% piperidine as the setting catalyst per kg of dry mixture. The slip is poured into a removable box around the shell and accompanied by slight vibration. It sets after 2 hours and is left to dry after 24 hours.

The block is heated to 150° C. in order to remove the wax and at 1OOO° C. in vacuo for coking and baking. The mould is ready for casting the titanium. The casting is then cast in vacuo in a titanium alloy with 6% aluminium and 1% vanadium melted by electron bombardment in vacuo.

EXAMPLE 2

In the aforementioned example 1, the fritted alumina in the composition of the block is replaced by zirconia ground into a consistency of dust of 0 to 50 microns. The results are similar.

EXAMPLE 3

The same results are obtained when the grain size of the graphite is between 0 and 6 mm.

Example 4

The same results are obtained by dipping the shell in ethyl silicate with 20% silica instead of colloidal silica.

We claim:

1. A green mould for lost pattern casting with a shell, said shell comprising a graphite coating and a hydrocarbon binder, the binder incorporating a polyol with at least three alcohol functions, said polyol being stable to decomposition and melting at temperatures of 200° C. and below to preserve the binding capability of said binder.

2. A mold according to claim 1, wherein said shell comprises multiple layers of graphite and binder.

3. A mould according to claim 1 or 2, wherein the binder comprises pentaerythritol.

4. A mould according to claim 1 or 2, wherein the polyol represents approximately 6 to 12% by weight of the shell.

5. A mould according to claim 1 or 2, wherein the graphite represents approximately 76 to 84% by weight of the shell and the binder correspondingly represents 24 to 16% by weight of the shell and contains, besides the polyol, a polyvinyl binder.

6. A mould according to claim 5, wherein the coating is an internal coating coated withan external mineral coating of colloidal silica, colloidal allumina or aluminosiliceous colloids.

7. A mould according to claim 6, wherein the external mineral coating represents approximately 4 to 6% of the weight of the shell constituted by the internal coating and the external coating.

8. A mould according to claim 1 or 2, wherein the shell is surrounded by a block comprising 40 to 50% by weight graphite, 15 to 25% by weight of a refractory mineral compound at 1800° C. and 30 to 40% by weight of a mineral binder based on colloidal silica, colloidal alumina and/or aluminosiliceous colloids.

* * * * *